US012465868B2

(12) United States Patent
Kamiyama

(10) Patent No.: US 12,465,868 B2
(45) Date of Patent: Nov. 11, 2025

(54) TABLE TOY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 197 days.

(21) Appl. No.: 18/386,025

(22) Filed: Nov. 1, 2023

(65) Prior Publication Data

US 2024/0149179 A1 May 9, 2024

(30) Foreign Application Priority Data

Nov. 4, 2022 (JP) ..... 2022-177259

(51) Int. Cl.
*A63H 3/52* (2022.01)
*A47B 3/06* (2006.01)

(52) U.S. Cl.
CPC ..... *A63H 3/52* (2013.01); *A47B 3/06* (2013.01)

(58) Field of Classification Search
CPC .. A63H 3/52; A63H 33/30; A47B 1/00; A47B 1/02; A47B 1/04; A47B 1/08; A47B 1/056; A47B 3/00; A47B 3/002; A47B 3/06; A47B 3/12; A47B 7/02; A47B 2001/085; A47B 2003/008; A47C 3/04; A47C 9/00; A47C 13/00
USPC ..... 108/11, 13, 14, 17, 25, 26, 33, 63, 64, 108/65, 69, 86, 89, 91, 93, 97, 101, 108/153.3, 154, 157, 158, 180, 185; 446/69, 482; 297/119, 120; 248/346.01, 248/558
See application file for complete search history.

(56) References Cited

U.S. PATENT DOCUMENTS

2013/0032066 A1* 2/2013 Huskey ..... A47B 1/04 312/240
2018/0236365 A1* 8/2018 Hradisky ..... B29C 41/04

FOREIGN PATENT DOCUMENTS

JP S63-008091 U 1/1988

* cited by examiner

*Primary Examiner* — Daniel J Troy
*Assistant Examiner* — Elizabeth Irene Artalejo
(74) *Attorney, Agent, or Firm* — Faegre Drinker Biddle & Reath LLP

(57) ABSTRACT

A table toy includes a main table and two auxiliary tables. In the main table, an interval between two main table side plates is formed to gradually decrease from a center portion of each of two main table side plates in a longitudinal direction toward two main table contact plates. Each of the two auxiliary tables includes a table leg, and an interval between two auxiliary table side plates is formed to gradually decrease from an auxiliary table contact plate toward an auxiliary table end plate.

6 Claims, 10 Drawing Sheets

TABLE TOY

CROSS-REFERENCE TO RELATED APPLICATIONS

This application is based on and claims priority under 35 USC 119 from Japanese Patent Application No. 2022-177259 filed on Nov. 4, 2022, the contents of which are incorporated herein by reference.

TECHNICAL FIELD

The present disclosure relates to a table toy used for doll play.

BACKGROUND ART

In the related art, a table toy that is used for doll play and can change a form has been disclosed. For example, JPS63-008091U discloses a table toy including a pair of tabletops that are connected to a plate-like support frame member through a hinge portion and include a folded tablecloth inside. The table toy can be played as a typical table when the tabletop is closed, can be played as a table where the tablecloth is laid on when the tabletop is opened, and can change a form depending on playing scenes to be changed.

SUMMARY OF INVENTION

When the form is changed depending on the scenes, for example, the opened tabletop can be hidden with the tablecloth to improve the design. On the other hand, in the table toy as a toy for doll play, a main object is a doll in every point. Therefore, for the table toy, a simpler configuration may be desired without providing the hinge portion or the like.

The present disclosure provides a table toy that can change a form while maintaining the design with a simple configuration.

The present disclosure provides a table toy including: a main table; and two auxiliary tables. The main table includes: a main table plate having a main table surface; two main table side plates provided to face each other, each of the two main table side plates including a main table side surface perpendicular to the main table surface; a locking projection provided on an inner side of each of the two main table side plates; two main table contact plates provided to face each other, each of the two main table contact plates including a main table contact surface perpendicular to the main table surface; and at least one engaging recess portion provided on an inner side of each of the two main table contact plates so as to be opened downward. An interval between the two main table side plates is formed to gradually decrease from a center portion of each of the two main table side plates in a longitudinal direction toward the two main table contact plates. Each of the two auxiliary tables includes: an auxiliary table plate having an auxiliary table surface; two auxiliary table side plates provided to face each other, each of the two auxiliary table side plates including an auxiliary table side surface perpendicular to the auxiliary table surface; an auxiliary table contact plate having an auxiliary table contact surface perpendicular to the auxiliary table surface and configured to contact the main table contact surface; at least one engaging protruding portion formed in a hook shape to protrude upward and configured to be engageable with the at least one engaging recess portion, respectively; an auxiliary table end plate provided to face the auxiliary table contact plate and having an end surface perpendicular to the auxiliary table surface; and a table leg. An interval between the two auxiliary table side plates is formed to gradually decrease from the auxiliary table contact plate toward the auxiliary table end plate. Each of the two auxiliary table side surfaces is configured to be engageable with the locking projection.

With the above-described configuration, a table toy that can change a form while maintaining the design can be provided with a simple configuration.

BRIEF DESCRIPTION OF DRAWINGS

The present disclosure will be described in detail based on the following without being limited thereto, wherein:

FIGS. 10A and 10B are schematic plan views illustrating a state when the main table and the auxiliary table are formed in a long rectangular shape, in which FIG. 10A illustrates the short table state and FIG. 10B illustrates the long table state.

DESCRIPTION OF EMBODIMENTS

An embodiment of the present disclosure will be described based on the drawings. A table toy 10 illustrated in FIGS. 1 to 7 is a furniture toy that can be used for doll play. The table toy 10 includes one main table 100 and two auxiliary tables 200. The table toy 10 can switch between a long table state illustrated in FIGS. 1 to 4 and a short table state illustrated in FIGS. 5 to 7.

In the following description, it is assumed that a table surface 11 side of the table toy 10 is an upper side and a side opposite to the upper side is a lower side.

Figure 1:
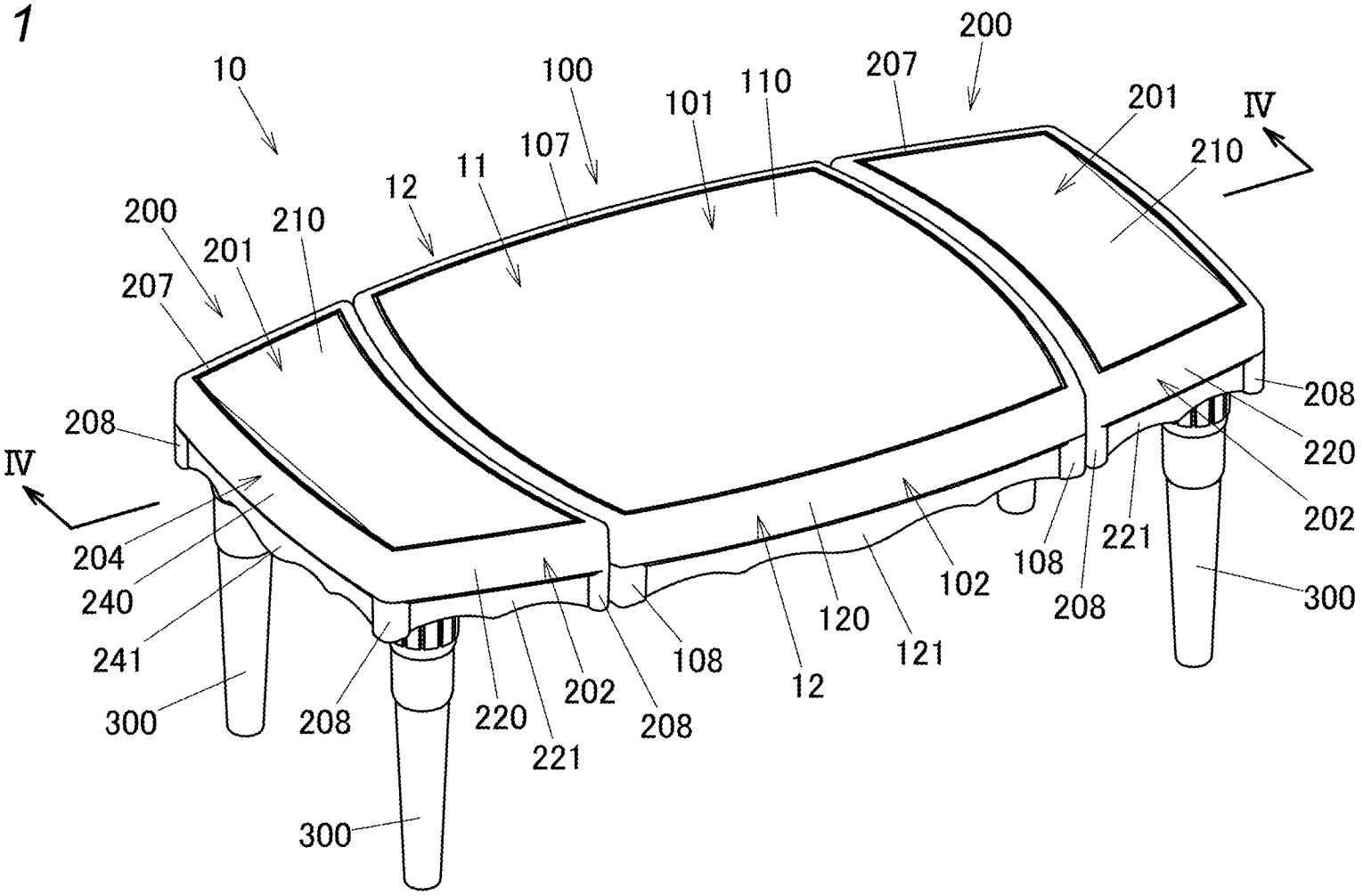
FIG. 1 is a perspective view illustrating a long table state of a table toy according to an embodiment of the present disclosure.
Figure 2:
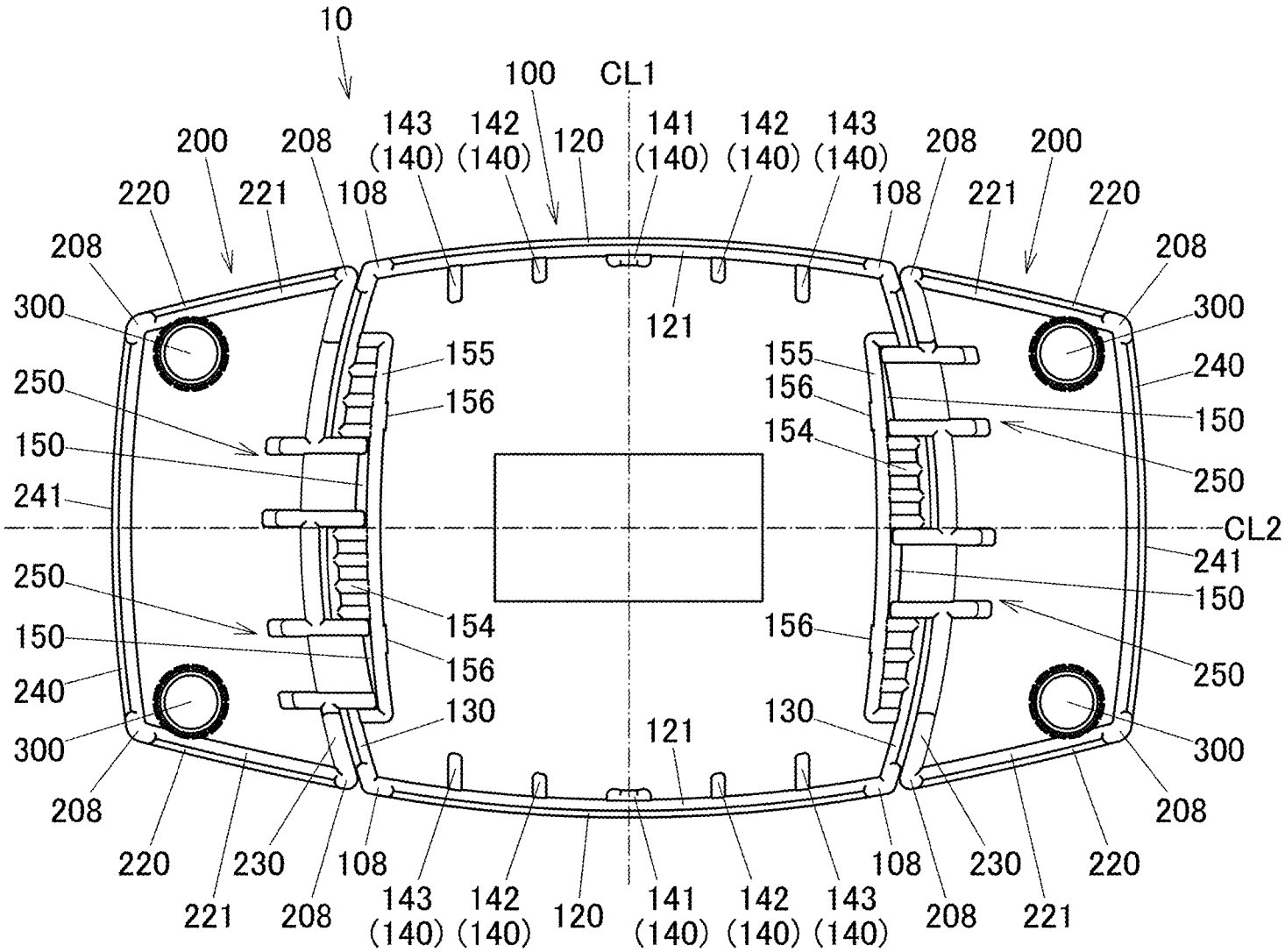
FIG. 2 is a bottom view illustrating the long table state of the table toy according to the embodiment of the present disclosure.
Figure 6:
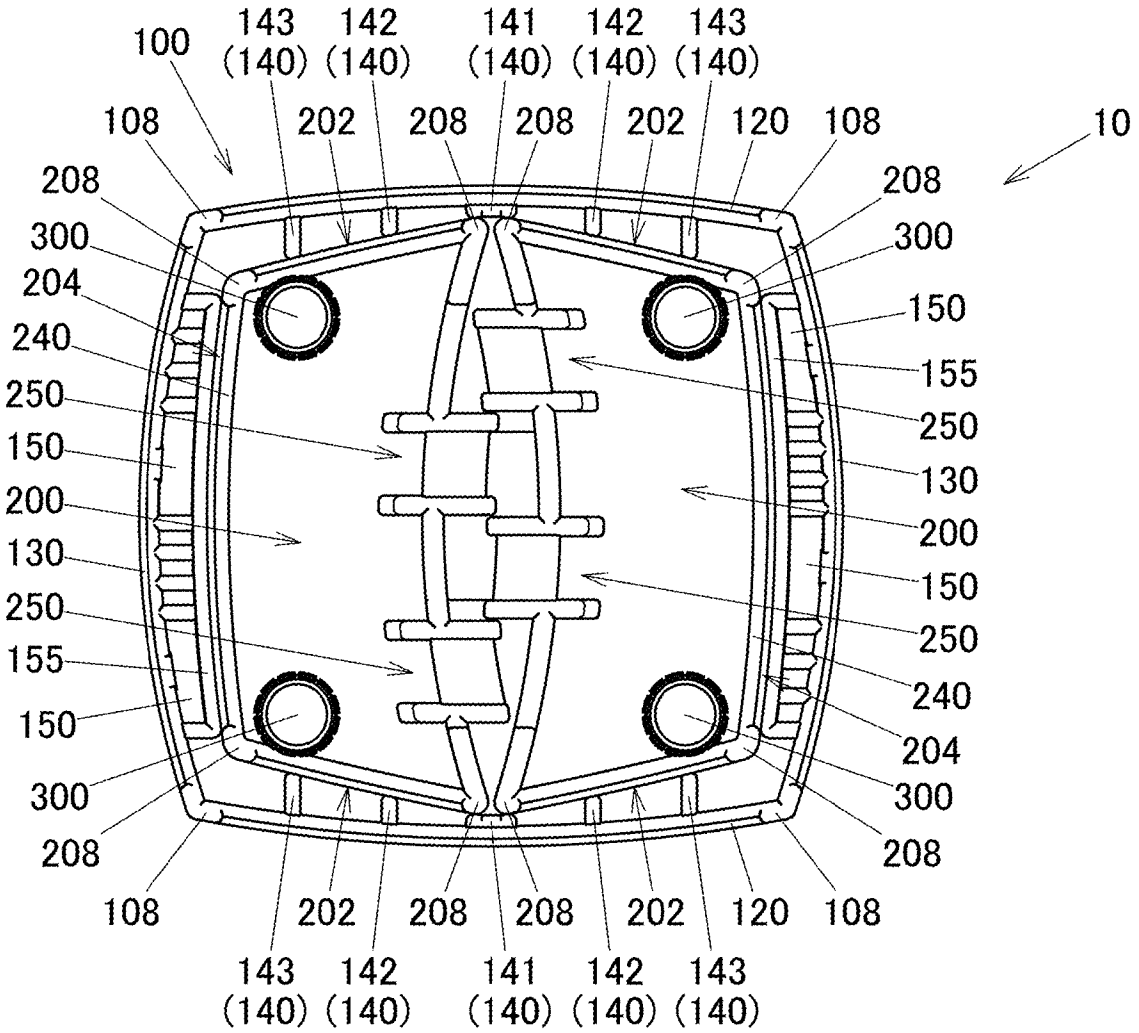
FIG. 6 is a bottom view illustrating the short table state of the table toy according to the embodiment of the present disclosure.

As illustrated in FIG. 1, in the main table 100, a main table plate 110 having a main table surface 101 configuring the table surface 11 of the table toy 10 in the long table state is provided. In two longitudinal edge portions of the main table 100 in the long table state, two main table side plates 120 having main table side surfaces 102 perpendicular to the main table surface 101 are provided to face each other. As illustrated in FIGS. 2 and 6, the main table side plate 120 (main table side surface 102) is formed in a convex curved shape when seen from the vertical direction. In other words, as illustrated in FIG. 2, an interval between the two main table side plates 120 (interval between the main table side surfaces 102) is formed to gradually decrease toward each of main table contact plates 130 described below from a center line CL1 that is a substantially center portion of the main table side plate 120 (main table side surface 102) in a longitudinal direction.

Figure 8:
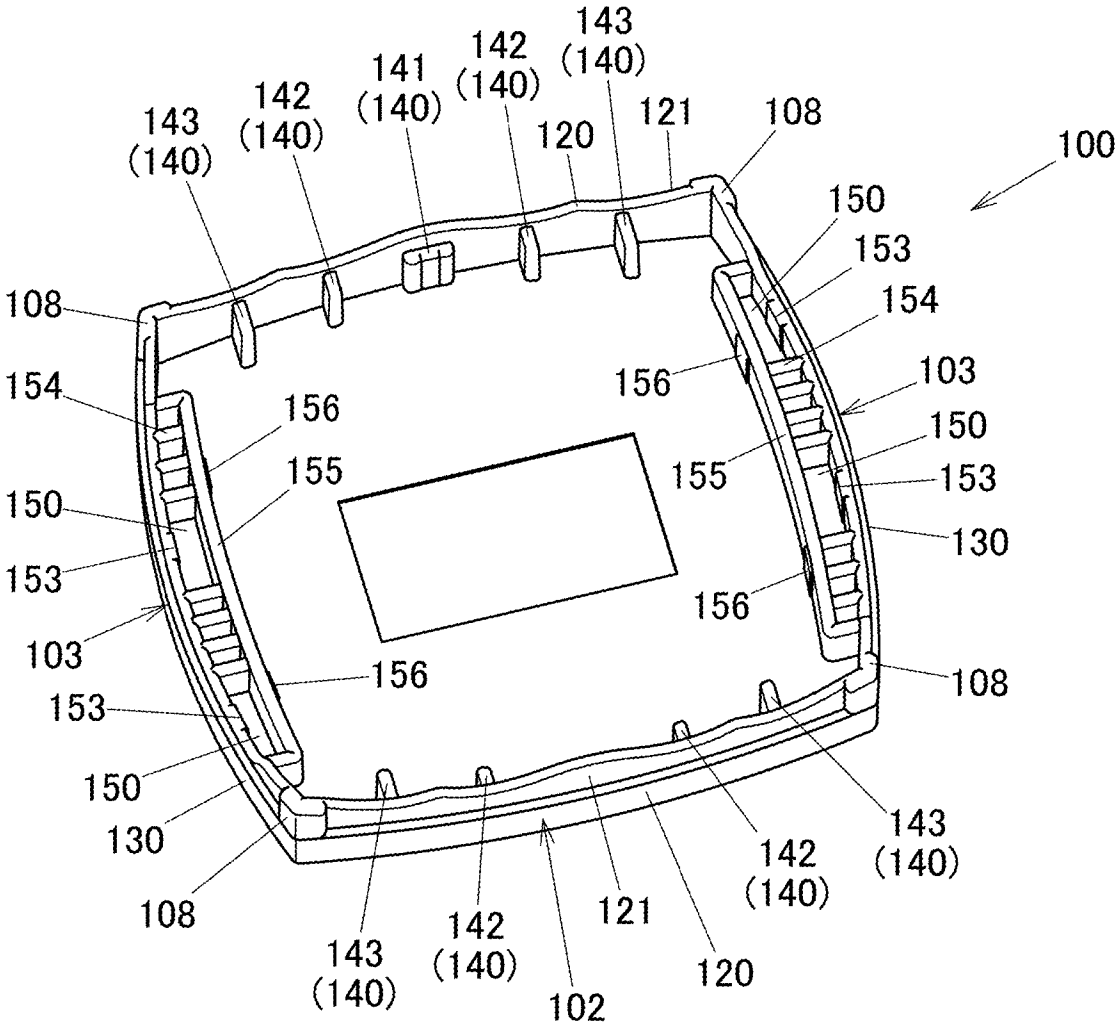
FIG. 8 is a perspective view illustrating a main table of the table toy according to the embodiment of the present disclosure when seen from the bottom.

As illustrated in FIGS. 1 and 8, about half of a lower side of the main table side plate 120, excluding corners 108 of the main table 100, is formed to be recessed from an outer surface so as to have a small plate thickness, and a lower end of the main table side plate 120 is formed as a wavy decorative plate 121. At the corners 108, the main table side plate 120 and the main table contact plate 130 are formed to intersect with each other.

Figure 5:
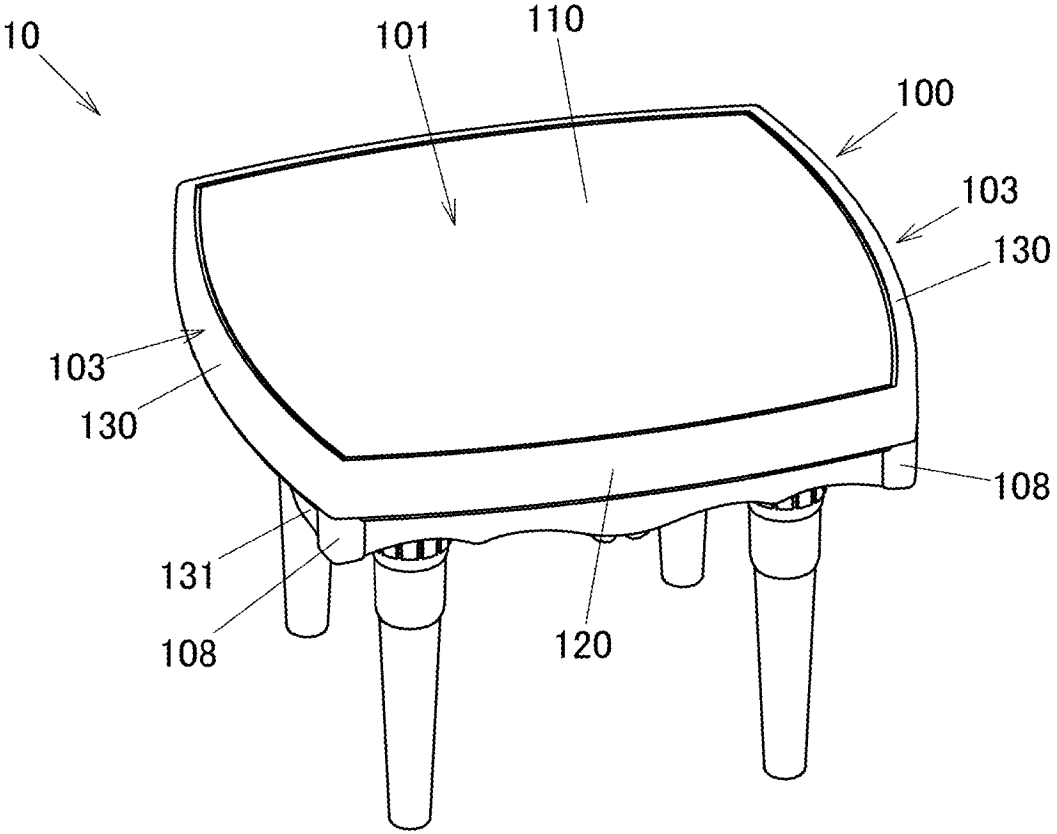
FIG. 5 is a perspective view illustrating a short table state of the table toy according to the embodiment of the present disclosure.
Figure 7:
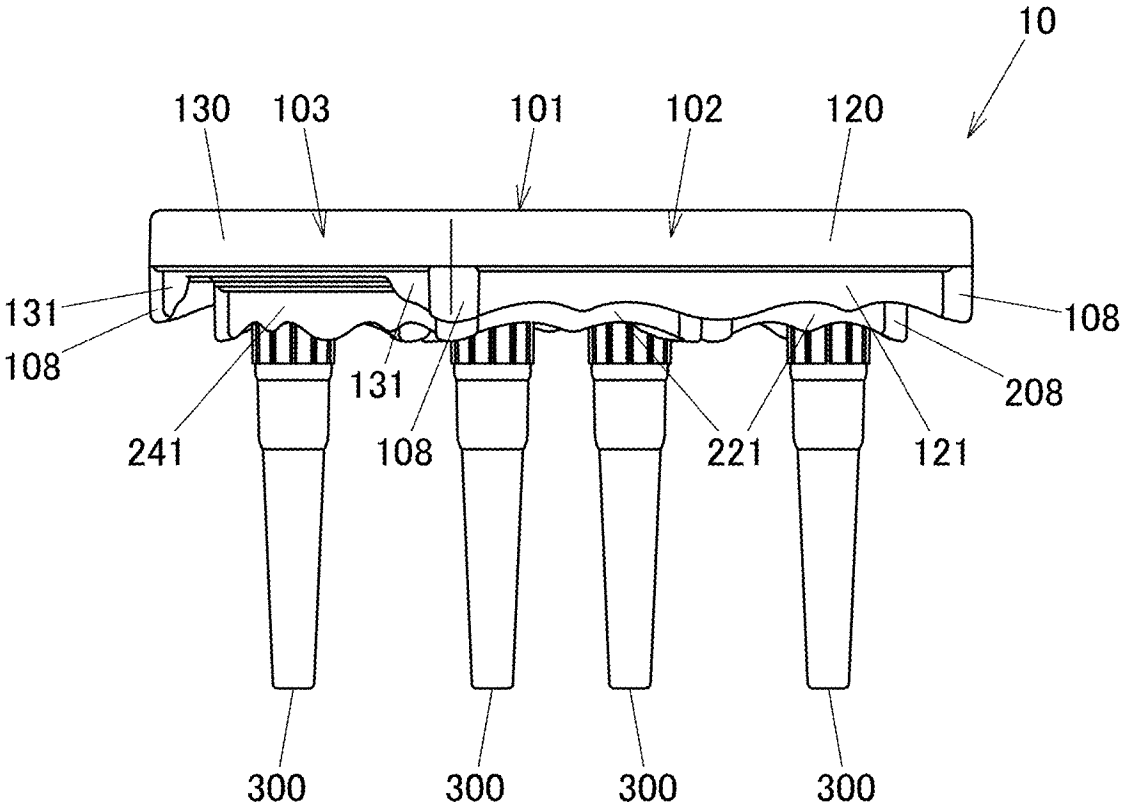
FIG. 7 is a perspective side view illustrating the short table state of the table toy according to the embodiment of the present disclosure.

As illustrated in FIGS. 5 and 8, in two transverse portions in the long table state of the main table 100, the main table contact plates 130 having a main table contact surface 103 perpendicular to the main table surface 101 are provided to face each other. As illustrated in FIG. 7, a lower end of the main table contact plate 130 is connected to a decorative plate 131 that is provided in a rib shape from the corners 108 at opposite ends. On a lower side of the main table contact plate 130 between the decorative plates 131, a space is formed, and the decorative plate is not provided. As illustrated in FIGS. 2 and 8, the main table contact plate 130 (main table contact surface 103) is formed in a convex curved shape when seen from the vertical direction.

The main table side plate 120 and the main table contact plate 130 are formed to be sufficiently long in a direction parallel to the main table plate 110 with respect to the vertical direction.

As illustrated in FIGS. 2 and 8, on an inner side of each of the main table side plates 120, a plurality of locking projections 140 having a rib shape are provided such that an inner surface of the main table side plate 120 (surface where the main table side plates 120 face each other) and a lower surface of the main table plate 110 are connected to each other. Among the locking projections 140, first locking projections 141 are provided in a substantially center of the inner side of the main table side plate 120 in the longitudinal direction. The first locking projections 141 are formed to be wider than the other locking projections 140 and is formed such that a center portion is slightly hollow. Second locking projections 142 are provided adjacent to each of both sides of the first locking projection 141. Third locking projections 143 are provided on the main table contact plate 130 side of each of the second locking projections 142. Regarding an interval between the locking projections 140 facing each other, an interval between the first locking projections 141 is the widest, and an interval between the third locking projections 143 is the narrowest.

On an inner side of each of the main table contact plates 130, a surrounding wall 155 that is connected to the lower surface of the main table plate 110, is formed in a substantially U-shape, and has opposite end portions connected to an inner surface of the main table contact plate 130 is provided. In the surrounding wall 155, a plurality of ribs 154 are provided such that the inner surface of the main table contact plate 130 and an inner surface of the surrounding wall 155 facing the inner surface of the main table contact plate 130 are connected to each other. A space in the main table contact plate 130 that is long in the longitudinal direction is formed by the rib 154, and the space functions as an engaging recess portion 150. On the inner surface of the main table contact plate 130 corresponding to the engaging recess portion 150 (surfaces of the main table contact plates 130, each of which faces the corresponding surrounding wall 155), a sliding projection 153 is provided. Also on the inner surface of the surrounding wall 155 (surfaces of the surrounding wall 155 facing each other), a sliding projection 156 is provided.

As illustrated in FIG. 2, two engaging recess portions 150 are disposed offset from a center line CL2 of the main table contact plate 130 in the longitudinal direction. More specifically, a center between two engaging recess portions 150 on one side (for example, two engaging recess portions 150 on the left side in FIG. 2) is disposed shifted to one main table side plate 120 side (for example, the main table side plate 120 side on the lower side in FIG. 2), and a center between two engaging recess portions 150 on the other side (for example, two engaging recess portions 150 on the right side in FIG. 2) is disposed shifted to the other main table side plate 120 side (for example, the main table side plate 120 side on the upper side in FIG. 2). In other words, the two engaging recess portions 150 disposed corresponding to the two main table contact plates 130 facing each other are point-symmetrically disposed with respect to the center of the main table 100.

As illustrated in FIG. 1, in the auxiliary table 200, an auxiliary table plate 210 having an auxiliary table surface 201 configuring the table surface 11 in the long table state is provided. On a lower surface of the auxiliary table plate 210, table legs 300 that extend downward are provided to be fixed. In the table leg 300, a pattern of a plurality of strips is formed at a base end portion, and the table leg 300 is formed in a tapered shape toward a lower end.

On the longitudinal side of the auxiliary table 200 in the long table state, two auxiliary table side plates 220 having auxiliary table side surfaces 202 perpendicular to the auxiliary table surface 201 are provided to face each other. As illustrated in FIGS. 2 and 6, the two auxiliary table side plates 220 (auxiliary table side surfaces 202) are linearly inclined in a direction in which the plates approach each other toward the outer side (transverse side in the long table state) when seen from the vertical direction. In other words, as illustrated in FIG. 2, an interval between the two auxiliary table side plates 220 (interval between the auxiliary table side surfaces 202) is formed to gradually decrease from an auxiliary table contact plate 230 described below toward an auxiliary table end plate 240 described below.

Figure 9:
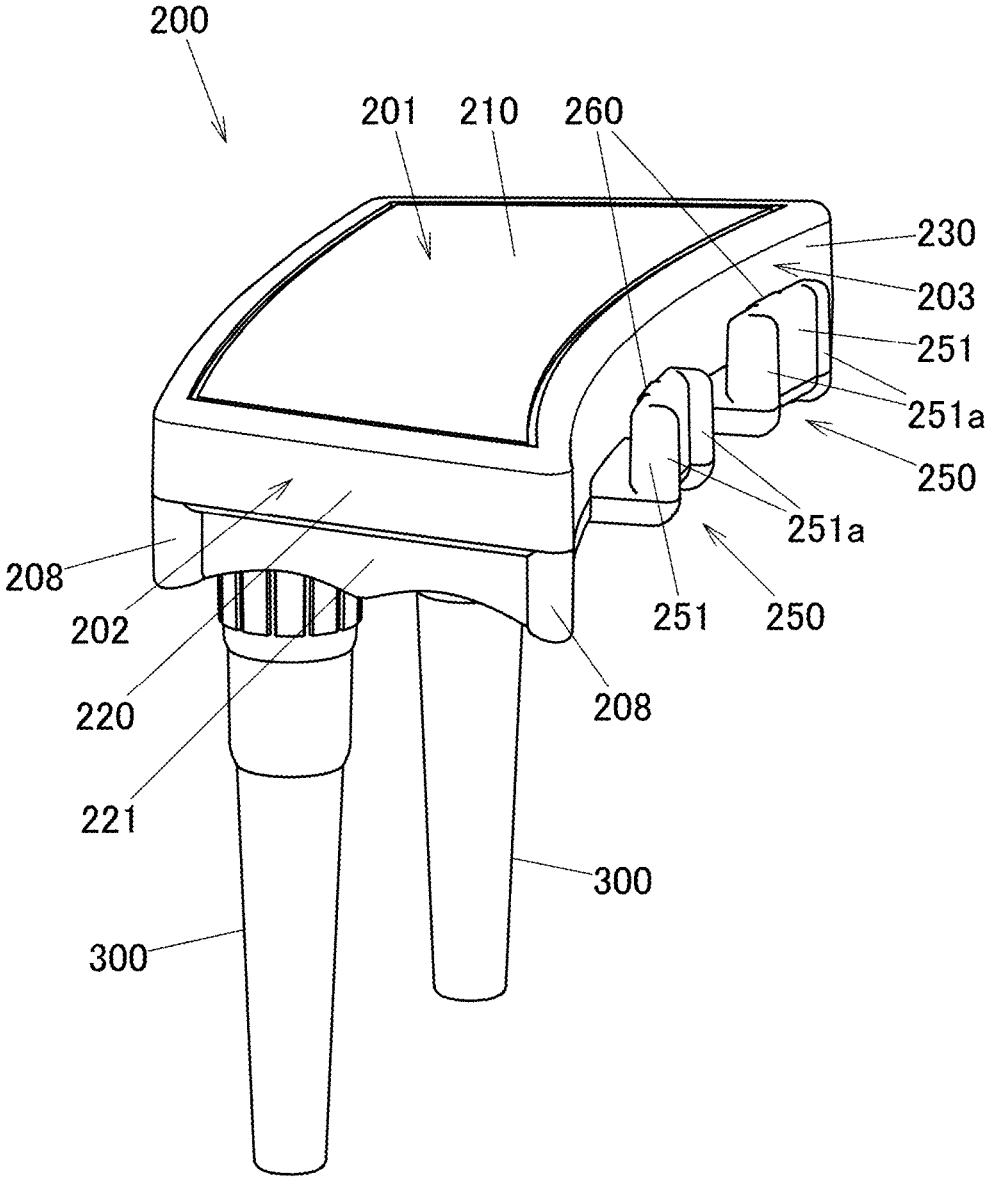
FIG. 9 is a perspective view illustrating an auxiliary table of the table toy according to the embodiment of the present disclosure.

As illustrated in FIGS. 1, 2, and 9, about half of a lower side of the auxiliary table side plate 220, excluding corners 208 of the auxiliary table 200, is formed to be recessed from an outer surface so as to have a small plate thickness, and a lower end of the auxiliary table side plate 220 is formed as a wavy decorative plate 221. At the corners 208, the auxiliary table side plate 220 and the auxiliary table contact plate 230 or the auxiliary table end plate 240 are formed to intersect with each other.

The auxiliary table side plate 220 and the auxiliary table contact plate 230 or the auxiliary table end plate 240 are formed to be sufficiently long in a direction parallel to the auxiliary table plate 210 with respect to the vertical direction.

As illustrated in FIG. 9, the auxiliary table 200 includes the auxiliary table contact plate 230 having an auxiliary table contact surface 203 perpendicular to the auxiliary table surface 201. The auxiliary table contact plate 230 (auxiliary table contact surface 203) is formed in a concave curved shape at the same curvature as that of the main table contact plate 130 to be contactable with the main table contact plate 130 (main table contact surface 103) of the main table 100.

In the auxiliary table contact plate 230, two engaging protruding portions 250 having a hook shape are provided. In the engaging protruding portion 250, an engaging portion 251 that protrudes upward is formed. In the engaging portion 251, a center portion is formed in a recessed shape, and an engaging contact portion 251*a* is formed at both thick side portions. In the engaging portion 251, a sliding projection 260 is provided on a surface facing the auxiliary table contact surface 203. The engaging protruding portion 250 is formed such that the engaging portion 251 is inserted into the engaging recess portion 150 of the main table 100 to be engageable in a protrusion-recess manner therewith. Therefore, the engaging protruding portions 250 are disposed offset from the center line CL2 (refer to FIG. 2) in the longitudinal direction of the auxiliary table contact plate 230 to correspond to the engaging recess portions 150.

As illustrated in FIG. 1, in the auxiliary table 200, the auxiliary table end plate 240 having an end surface 204 perpendicular to the auxiliary table surface 201 is provided. As illustrated in FIGS. 1 and 2, about half of a lower side of the auxiliary table end plate 240, excluding the corners 208 of the auxiliary table 200, is formed to be recessed from an outer surface so as to have a small plate thickness, and a lower end of the auxiliary table end plate 240 is formed as a wavy decorative plate 241.

Figure 4:
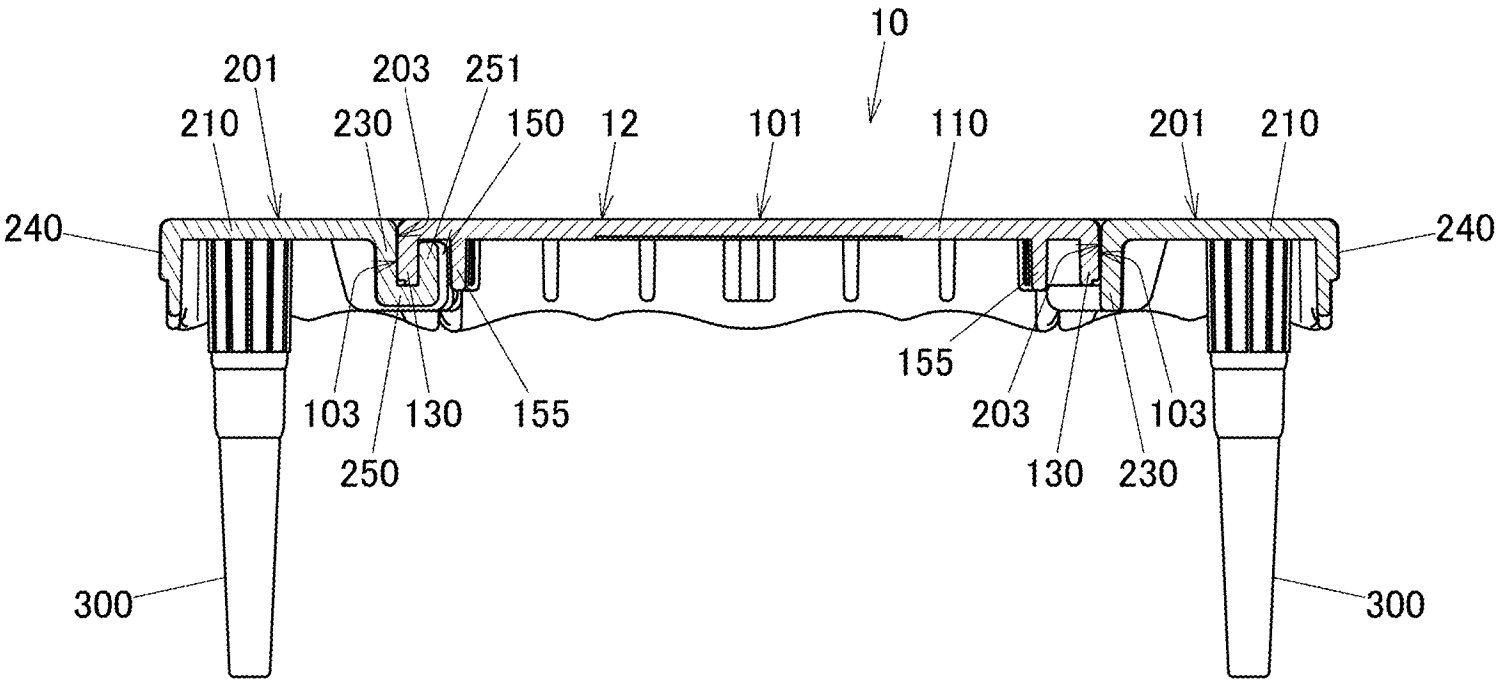
FIG. 4 is a cross-sectional view taken along IV-IV of FIG. 1 illustrating the table toy according to the embodiment of the present disclosure.

When the table toy 10 is used in the long table state, the engaging protruding portion 250 of the auxiliary table 200 engages in a protrusion-recess manner with the engaging recess portion 150 of the main table 100. As illustrated in FIG. 4, when the engaging protruding portion 250 and the engaging recess portion 150 engage in a protrusion-recess manner with each other, the engaging portion 251 is inserted into the engaging recess portion 150, and the main table contact plate 130 of the main table 100 is disposed between the engaging portion 251 and the auxiliary table contact surface 203. Here, the auxiliary table contact surface 203 and the main table contact surface 103 are close to each other or contact each other. The sliding projection 260 of the engaging portion 251 slidingly contacts with the sliding projection 153 of the engaging recess portion 150, and the engaging contact portion 251*a* (refer to FIG. 9) is strongly pressed against and comes into contact with the surrounding wall 155.

Figure 3:
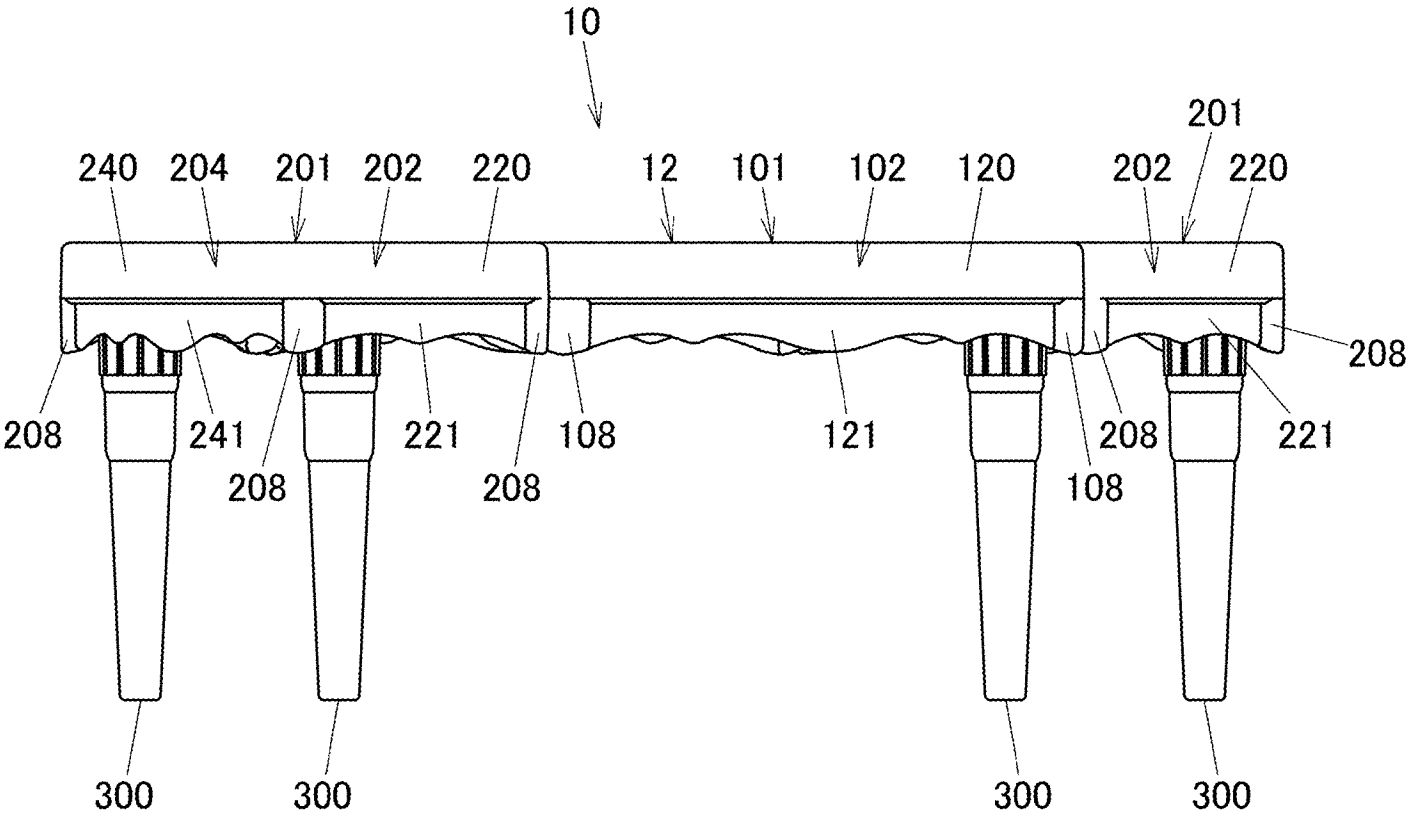
FIG. 3 is a perspective side view illustrating the long table state of the table toy according to the embodiment of the present disclosure.

As illustrated in FIG. 3, in the long table state, the main table surface 101 configuring the table surface 11 and the two auxiliary table surfaces 201 are continuous to each other. A side surface 12 of the table toy 10 in the longitudinal direction is formed such that the main table side surface 102 and the two auxiliary table side surfaces 202 are substantially continuous to each other. The reason is that the main table side plate 120 (main table side surface 102) is formed in a convex curved shape and an interval between the main table side plate 120 and the auxiliary table side plate 220 gradually decreases such that a step difference is not generated on the side surface 12.

Figure 10A:
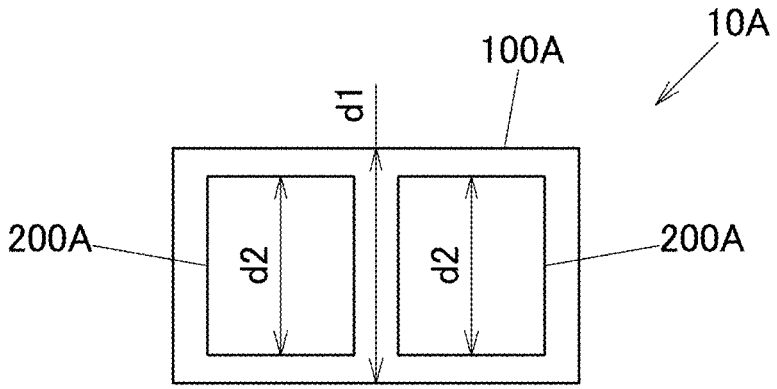
Figure 10B:
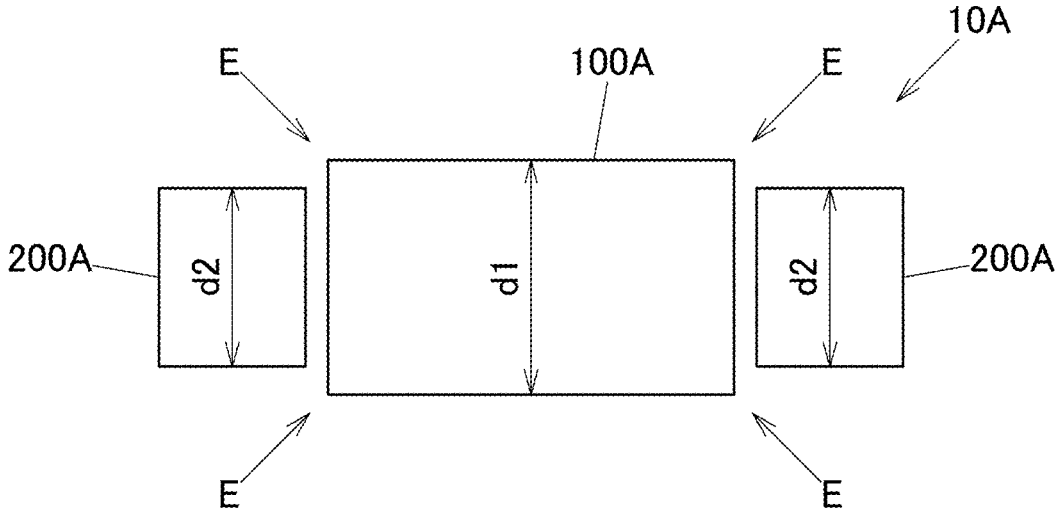

For example, as illustrated in FIGS. 10A and 10B, when a main table 100A and auxiliary tables 200A of a table toy 10A are formed in a long rectangular shape and the two auxiliary tables 200A can be stored in a lower surface of the main table 100A in the short table state of FIG. 10A, a depth dimension d2 of the auxiliary tables 200A is less than a depth dimension d1 of the main table 100A. When the table toy 10A is in the long table state, as illustrated in FIG. 10B, a step difference E is generated on a side surface of the table toy 10A in a portion where the main table 100A and the auxiliary table 200A are connected.

However, in the table toy 10 according to the embodiment of the present disclosure, the main table side plate 120 (main table side surface 102) is formed in a convex curved shape, and the interval between the main table side plate 120 and the auxiliary table side plate 220 is formed to gradually decrease. As a result, the short table state where the two auxiliary tables 200 are stored in the main table 100 can be established, and even in the long table state where the auxiliary tables 200 are connected to both ends of the main table 100, a beautiful design having no step difference can be exhibited.

A transverse direction of the table toy 10 is along the end surface 204 of the auxiliary table 200. On a side surface outer periphery of the table toy 10, lower ends of the decorative plates 121, 221, and 241 are wavy. Therefore, even when three components are combined, a design having no discomfort in a connection portion thereof can be exhibited.

On the other hand, in the short table state, the protrusion-recess engagement between the engaging recess portion 150 and the engaging protruding portion 250 is released such that the main table 100 and the auxiliary table 200 are separated from each other, and the auxiliary table 200 is attached to the lower surface side of the main table plate 110 such that the auxiliary table surface 201 of the auxiliary table 200 and the lower surface of the main table plate 110 face each other as illustrated in FIG. 6. Here, the locking projections 140 slidingly contacts with the auxiliary table side surface 202, and the auxiliary table 200 is held and locked between the locking projections 140 facing each other. The locking projections 140 are formed such that the first locking projection 141, the second locking projection 142, and the third locking projection 143 have different lengths, and thus match with the inclined auxiliary table side surface 202. As a result, the auxiliary table 200 is positioned relative to the main table 100 in the longitudinal direction of the main table contact plate 130.

The sliding projection 156 (refer to FIG. 8) of the surrounding wall 155 slidingly contacts with the end surface 204, and the end surface 204 and a surface of the surrounding wall 155 facing the end surface 204 are close to each other or slidingly contact with each other. Due to the sliding projection 156, in the table toy 10, even when the main table 100 is lifted while being played in the short table state, the falling of the auxiliary table 200 can be prevented. Due to the sliding projection 156, the table toy 10 is fixed to the extent where playing is not interfered where the auxiliary tables 200 are pressed against each other in the short table state. When the auxiliary table 200 is removed, the frictional force is low due to the sliding projection 156 and the end surface 204 having a narrow width. Therefore, the auxiliary table 200 can be easily removed even by children's strength.

In the short table state, one pair of the engaging protruding portions 250 facing each other are disposed to mesh with each other. As a result, the auxiliary tables 200 can be stored in the lower side of the main table 100 while the short table state being more compact.

As illustrated in FIG. 7, in the short table state, when seen from the side surface, the decorative plate 221 of the auxiliary table 200 disposed on the depth side of the decorative plate 121 is exposed from a lower end of the decorative plate 121 of the main table 100. Accordingly, even in the short table state, a design having no discomfort can be exhibited due to the wavy decorative plates 121 and 221. In the short table state, the main table contact surface 103 is exposed, and the decorative plate 241 of the auxiliary table 200 on the depth side is exposed from a gap between the decorative plates 131. Accordingly, when the engaging recess portion 150 and the engaging protruding portion 250 engage with each other, the engaging protruding portion 250 engages through the gap between the decorative plates 131, and thus a space is formed between the decorative plates 131. In the short table state, the wavy decorative plate 241 is exposed, and thus a design having no discomfort can be exhibited even when seen from the main table contact surface 103 side.

On the main table surface 101 and the auxiliary table surface 201, annular grooves 107 and 207 are provided along R ends of edge portions, and the table surfaces exhibit the same designs even in both of the long table state and the short table state.

With the above-described embodiment of the present disclosure, a table toy having the following aspects can be provided.

A table toy according to a first aspect includes: a main table; and two auxiliary tables. The main table includes: a main table plate having a main table surface; two main table side plates provided to face each other, each of the two main table side plates including a main table side surface perpendicular to the main table surface; a locking projection provided on an inner side of each of the two main table side plates; two main table contact plates provided to face each other, each of the two main table contact plates including a main table contact surface perpendicular to the main table surface; and at least one engaging recess portion provided on an inner side of each of the two main table contact plates so as to be opened downward. An interval between the two main table side plates is formed to gradually decrease from a center portion of each of the two main table side plates in a longitudinal direction toward the two main table contact plates. Each of the two auxiliary tables includes: an auxiliary table plate having an auxiliary table surface; two auxiliary table side plates provided to face each other, each of the two auxiliary table side plates including an auxiliary table side surface perpendicular to the auxiliary table surface; an auxiliary table contact plate having an auxiliary table contact surface perpendicular to the auxiliary table surface and configured to contact the main table contact surface; at least one engaging protruding portion formed in a hook shape to protrude upward and configured to be engageable with the at least one engaging recess portion, respectively; an auxiliary table end plate provided to face the auxiliary table contact plate and having an end surface perpendicular to the auxiliary table surface; and a table leg. An interval between the two auxiliary table side plates is formed to gradually decrease from the auxiliary table contact plate toward the auxiliary table end plate. Each of the two auxiliary table side surfaces is configured to be engageable with the locking projection.

With such configuration, when the main table contact plate and the auxiliary table contact plate come into contact with each other to establish the long table state, the main table side surface and the auxiliary table side surface can be formed to be continuous to each other, and the auxiliary table surfaces can be stored in the lower surface side of the main table to establish the short table state. Therefore, a table toy that can change a form while maintaining the design can be provided with a simple configuration.

According to a second aspect of the table toy, the main table contact surface is formed in a convex curved shape, and the auxiliary table contact surface is formed in a concave curved shape.

With such configuration, the main table contact surface that is exposed in the short table state is formed in a convex curved shape, and thus a good design can be exhibited.

According to a third aspect of the table toy, the main table side surface is formed in a convex curved shape, and the auxiliary table side surface is formed in a flat shape.

With such configuration, while forming the main table side surface in a convex curved shape to improve the design, the flat auxiliary table side surface can ensure the holding by the locking projections when attached to the lower surface of the main table.

According to a fourth aspect of the table toy, a lower end of each of the two main table side plates, a lower end of each of the two auxiliary table side plates, and a lower end of the auxiliary table end plate are formed in a wavy shape.

With such configuration, in both of the long table state and the short table state, when the table toy is seen from the side surface, a connection portion, a step difference, and the like between the main table and the auxiliary table can be made inconspicuous, and a table toy having a good design can be provided.

According to a fifth aspect of the table toy, the at least one engaging recess portion includes two engaging recess portions, and the two engaging protruding portions provided on one of the two main table contact plates are offset from the two engaging protruding portions provided on another of the two main table contact plates with respect to a center of the interval between the two main table side plates. The at least one engaging protruding portion includes two engaging protruding portions, and the two engaging protruding portions provided on one of the two auxiliary tables are offset from the two engaging protruding portions provided on another of the two auxiliary tables with respect to a center of the interval between the two auxiliary table side plates.

With such configuration, the auxiliary tables can be stored in the main table such that the two engaging protruding portions mesh with each other, and thus the size of the main table can be reduced.

According to a sixth aspect of the table toy, the auxiliary table end plate is formed in a convex curved shape.

With such configuration, a table toy having a good design can be provided.

Hereinabove, the embodiment of the present disclosure has been described. However, the present disclosure is not limited to the above-described embodiment, and various changes can be made within a range not departing from the scope of the present disclosure.

What is claimed is:

1. A table toy comprising:

a main table; and two auxiliary tables, wherein the main table comprises:

a main table plate having a main table surface;

two main table side plates provided to face each other, each of the two main table side plates comprising a main table side surface perpendicular to the main table surface;

a locking projection provided on an inner side of each of the two main table side plates;

two main table contact plates provided to face each other, each of the two main table contact plates comprising a main table contact surface perpendicular to the main table surface; and at least one engaging recess portion provided on an inner side of each of the two main table contact plates so as to be opened downward, wherein an interval between the two main table side plates is formed to gradually decrease from a center portion of each of the two main table side plates in a longitudinal direction toward the two main table contact plates, wherein each of the two auxiliary tables comprises:

an auxiliary table plate having an auxiliary table surface;

two auxiliary table side plates provided to face each other, each of the two auxiliary table side plates comprising an auxiliary table side surface perpendicular to the auxiliary table surface;

an auxiliary table contact plate having an auxiliary table contact surface perpendicular to the auxiliary table surface and configured to contact the main table contact surface;

at least one engaging protruding portion formed in a hook shape to protrude upward and configured to be engageable with the at least one engaging recess portion, respectively;

an auxiliary table end plate provided to face the auxiliary table contact plate and having an end surface perpendicular to the auxiliary table surface; and a table leg, wherein an interval between the two auxiliary table side plates is formed to gradually decrease from the auxiliary table contact plate toward the auxiliary table end plate, and wherein each of the two auxiliary table side surfaces is configured to be engageable with the locking projection.

2. The table toy according to claim 1, wherein the main table contact surface is formed in a convex curved shape, and the auxiliary table contact surface is formed in a concave curved shape.

3. The table toy according to claim 1, wherein the main table side surface is formed in a convex curved shape, and the auxiliary table side surface is formed in a flat shape.

4. The table toy according to claim 1, wherein a lower end of each of the two main table side plates, a lower end of each of the two auxiliary table side plates, and a lower end of the auxiliary table end plate are formed in a wavy shape.

5. The table toy according to claim 1, wherein the at least one engaging recess portion comprises two engaging recess portions, and the two engaging recess portions provided on one of the two main table contact plates are offset from the two engaging recess portions provided on another of the two main table contact plates with respect to a center of the interval between the two main table side plates, and wherein the at least one engaging protruding portion comprises two engaging protruding portions, and the two engaging protruding portions provided on one of the two auxiliary tables are offset from the two engaging protruding portions provided on another of the two auxiliary tables with respect to a center of the interval between the two auxiliary table side plates.

6. The table toy according to claim 1, wherein the auxiliary table end plate is formed in a convex curved shape.

* * * * *